US006000817A

United States Patent [19]

Chan

[11] Patent Number: 6,000,817

[45] Date of Patent: Dec. 14, 1999

[54] LAMP WITH COILED INTERCHANGEABLE SHADE

[76] Inventor: Michael L. F. Chan, 1407 Arch St., Berkeley, Calif. 94708

[21] Appl. No.: 09/093,434

[22] Filed: Jun. 8, 1998

[51] Int. Cl.[6] ..... F21V 1/06

[52] U.S. Cl. ..... 362/352; 362/311; 362/361

[58] Field of Search ..... 362/352, 311, 362/351, 355, 356, 362, 410, 414

[56] References Cited

U.S. PATENT DOCUMENTS

| | | | |
|---|---|---|---|
| 2,586,389 | 2/1952 | Schear et al. | 362/352 |
| 2,853,598 | 9/1958 | Balthauser | 362/352 |
| 3,689,762 | 9/1972 | Shatan | 240/81 C |
| 4,075,684 | 2/1978 | Witz | 362/352 |
| 4,117,533 | 9/1978 | Hagelthorn | 362/311 |
| 4,268,896 | 5/1981 | Mann | 362/311 |
| 4,337,505 | 6/1982 | Heimo | 362/352 |
| 4,344,115 | 8/1982 | Pickens | 362/216 |
| 4,878,162 | 10/1989 | Wu | 362/352 |
| 5,598,652 | 2/1997 | Nurre | 40/553 |
| 5,797,671 | 8/1998 | Gess | 362/352 |

*Primary Examiner*—Thomas M. Sember

*Attorney, Agent, or Firm*—Thomas Schneck; John P. McGuire, Jr.

[57] ABSTRACT

A lamp having a coiled lamp shade disposed within and extending upwardly out of a frame assembly. The lamp shade is made of a translucent sheet, arranged in a loop or coil which bulges outwardly to form a wall which surrounds a lamp bulb assembly. The lamp shades can be of varying heights and shapes and is easily interchangeable with other lamp shades of the same type. In the preferred embodiment of the invention, the frame assembly is a modular kit, having vertical and horizontal parts, which can be assembled to form a rectangular frame. Alternately, other types of frame assemblies, such as round shaped or preassembled frames, can be used.

8 Claims, 3 Drawing Sheets

LAMP WITH COILED INTERCHANGEABLE SHADE

TECHNICAL FIELD

This invention relates generally to the area of lamps, and more specifically to a table lamp having an interchangeable lamp shade.

BACKGROUND ART

There have been numerous designs for table lamps, many of which are comprised of a bulb socket supported by some means to maintain the socket above the table surface, such as a pedestal or other type of frame assembly, and with the bulb socket being surrounded by a lamp shade to soften or diffuse the light emitted by the bulb. In some lamps, the lamp shades are suspended around the frame assembly, while other designs incorporate the shade within the frame assembly.

U.S. Pat. No. 3,689,762 to Shatan, discloses a modular table lamp formed from a kit that is assembled to create a table lamp having a box-like shade whose corners are supported on straight legs. The kit includes a set of four modules, each composed of a translucent panel, one edge of which is joined to a post whose length is greater than the length of the panel, the post having a longitudinal groove therein adapted to receive the free edge of the panel of an adjoining module whereby when assembled, the four modules define a box-line shape supported on corner posts. Four legs are provided, each leg serving to lock one of the module posts to an adjoining panel.

U.S. Pat. No. 5,598,652 to Nurre discloses a lamp with a changeable display base. The lamp base has an external transparent sleeve and an interior, outwardly tensioning rigid or semi-rigid thin flexible sleeve or sheet which bears upon the interior of the external transparent sleeve due to outward tension. The rigid or semi-rigid thin flexible sleeve or sheet is capable of securing decorative materials, the decorative materials being easily changed as desired by the lamp owner.

It is the object of the present invention to provide a lamp having a coiled lamp shade that is easily interchangeable.

It is another object to the present invention to provide a lamp having a modular frame assembly, yet having the lamp shade neither suspended from the frame assembly nor incorporated within the frame assembly.

SUMMARY OF THE INVENTION

The above objects have been met by a lamp having a coiled lamp shade disposed within a frame assembly. The lamp shade is made of a translucent sheet, arranged in a loop, which bulges outwardly to form a wall inside of the perimeter of the frame assembly and surrounds a lamp bulb assembly.

The lamp shade can be of varying heights and shapes, as these features are not necessarily dependent on or limited by the height and shape of the frame assembly. For example, the lamp shade can be of the same height as the frame assembly or it can be twice as tall as the frame assembly or even taller. The lamp shade can be assembled into a rectangular shape or a round shape. The lamp shade can be easily interchangeable and replaceable by another lamp shade of the same type having a different height, shape, or decorative pattern.

Due to the nature of the lamp shade construction to support itself, the frame assembly is not relied upon for total support. The present invention can be implemented with a variety of types of frame assemblies. In the preferred embodiment of the invention, the frame assembly is a modular kit that has vertical and horizontal parts which can be assembled to form a rectangular frame. Alternatively, the frame assembly can be already preassembled or can be a singular piece unit or can be constructed in shapes other than rectangular, such as a round shape.

BEST MODE FOR CARRYING OUT THE INVENTION

Figure 1:
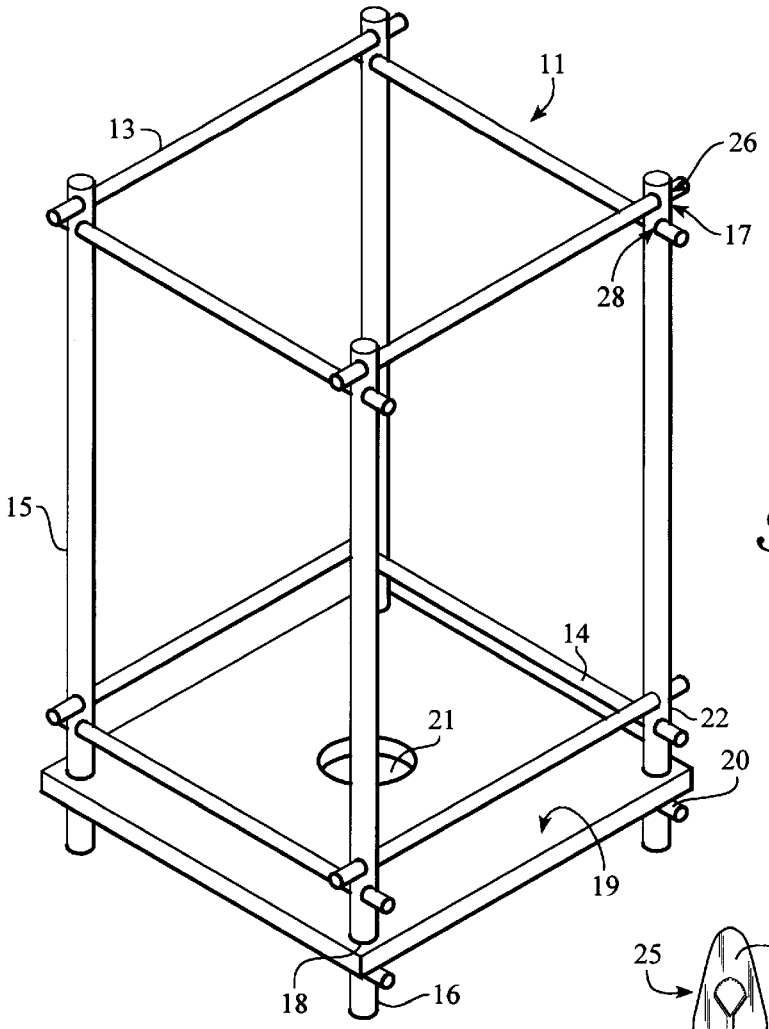
FIG. 1 is a perspective view of a preferred frame assembly used in the present invention.

Referring to FIG. 1, the preferred frame assembly 11 used in the present invention is shown. The frame assembly is a modular kit consisting of four vertical posts 15, four upper horizontal members 13, four lower horizontal members 14, and a rectangular flat base plate 19, which are assembled to form the frame assembly 11. The modular kit construction allows for the frame assembly to be easily packaged, stored, or transported. To assemble the frame assembly 11, the four vertical posts 15 are mounted on base plate 19 by inserting the vertical posts 15 through holes 18 in the four respective corners of the base plate 19. Each of the holes 18 in the corners of the base plate 19 are large enough to accept the ends of the vertical posts 15. There are four short horizontal support members 20 which are attached beneath the base plate 19 through holes in the vertical posts 15. After the vertical posts 15 are inserted through the holes 18 in the base plate 19, the base plate 19 rests on the support members 20 such that there is a space between the base plate 19 and the surface on which the lamp rests. The portion of each vertical post 15 below the base plate 19 constitutes one of the four legs 16.

Each of the four upper horizontal members 13 are connected perpendicularly to the vertical posts 15 at a connection point 17. At each connection point 17, there are two holes in the vertical posts 15 to accept the upper horizontal members 13. The horizontal members are arranged such that two upper horizontal members 13 connect perpendicularly at each connection point, with one horizontal member in an upper hole 26 and the other horizontal member being in a lower hole 28. There are also four connection points 22 at the lower end of the vertical posts 15, spaced just above the base plate 19, for connection of the four upper horizontal members 14 to the vertical posts 15. The method of connecting the lower horizontal members 14 to the vertical post 15 is the same as the method for connecting the upper horizontal members 13 to the vertical post 15, described above. Thus, the connection points 17 are identical to the lower connection points 22. A typical overall size of the frame assembly is 14 in. by 8 in. by 8 in. Disposed in the center of the base plate 19, is a lamp opening 21, which is shaped in a circle of a diameter large enough to support the lamp bulb assembly.

Figure 2:
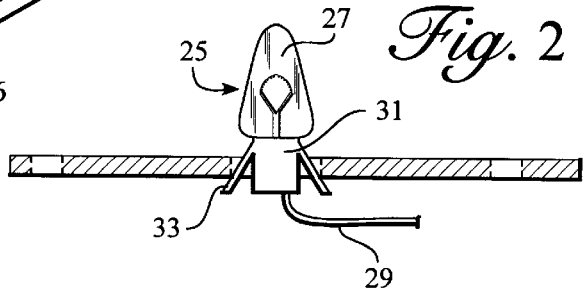
FIG. 2 is a perspective view of the lamp bulb assembly used in the present invention.

FIG. 2 shows the lamp bulb assembly 25. The lamp bulb assembly consists of a lamp socket 31 in which a bulb 27 is inserted. A power cord 29 is connected to the lamp socket 31 to supply the necessary power to light the lamp bulb 27. Referring to FIGS. 1 and 2, the lamp bulb assembly 25 is disposed within the lamp opening 21 in the frame assembly 11. The lamp socket 31 has a pair of detents 33 on either side of the lamp socket 31. The detents fit within the lamp opening 21, such that the lamp bulb assembly 25 is wedged within the lamp opening 21 and held in place by the detents 33.

Figure 3:
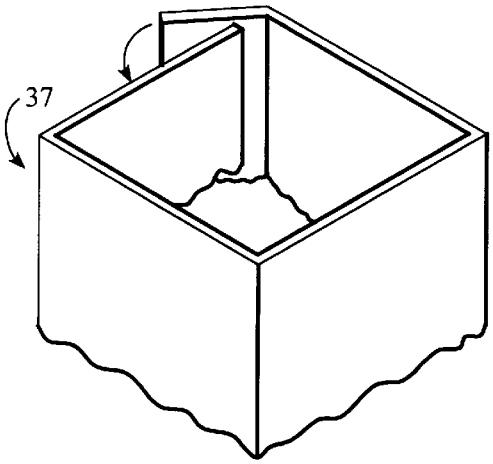
FIG. 3 is a perspective view of a first type of lamp shade used in the present invention.
Figure 4:
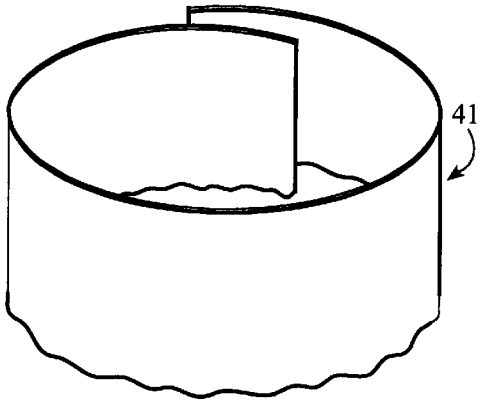
FIG. 4 is a perspective view of a second type of lamp shade used in the present invention.

FIG. 3 shows the lamp shade 37. The lamp shade 37 can be made of various types of paper or cloth, as long as the material has enough stiffness and has a consistency to allow the lamp shade to be coiled to bulge outwardly in a frame. If the material used to make the lamp shade 37 is too flimsy or fragile, it will collapse without some type of support mechanism. The lamp shade 37 should be of a translucent material, so that the light can shine through the material to provide illumination. The lamp shade material can be of many different colors or have a wide variety of decorative patterns. The material used for the lamp shade is arranged in a loop or coil which bulges outwardly to form a wall. The material is looped around until it overlaps and then is secured at the overlap to form a loop or coil. In FIG. 3, the lamp shade 37 is folded so that the wall is formed in a rectangular shape. In FIG. 4, another embodiment of the lamp shade 41 is shown. In this embodiment, the lamp shade 41 is formed in a round, circular shape.

Figure 5:
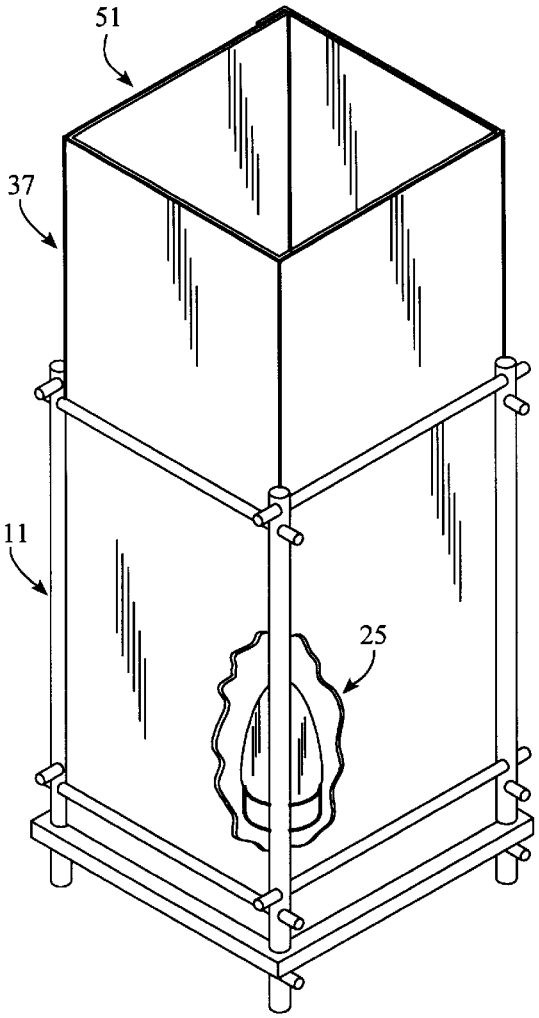
FIG. 5 is a perspective view of a first embodiment of the lamp of the present invention.
Figure 6:
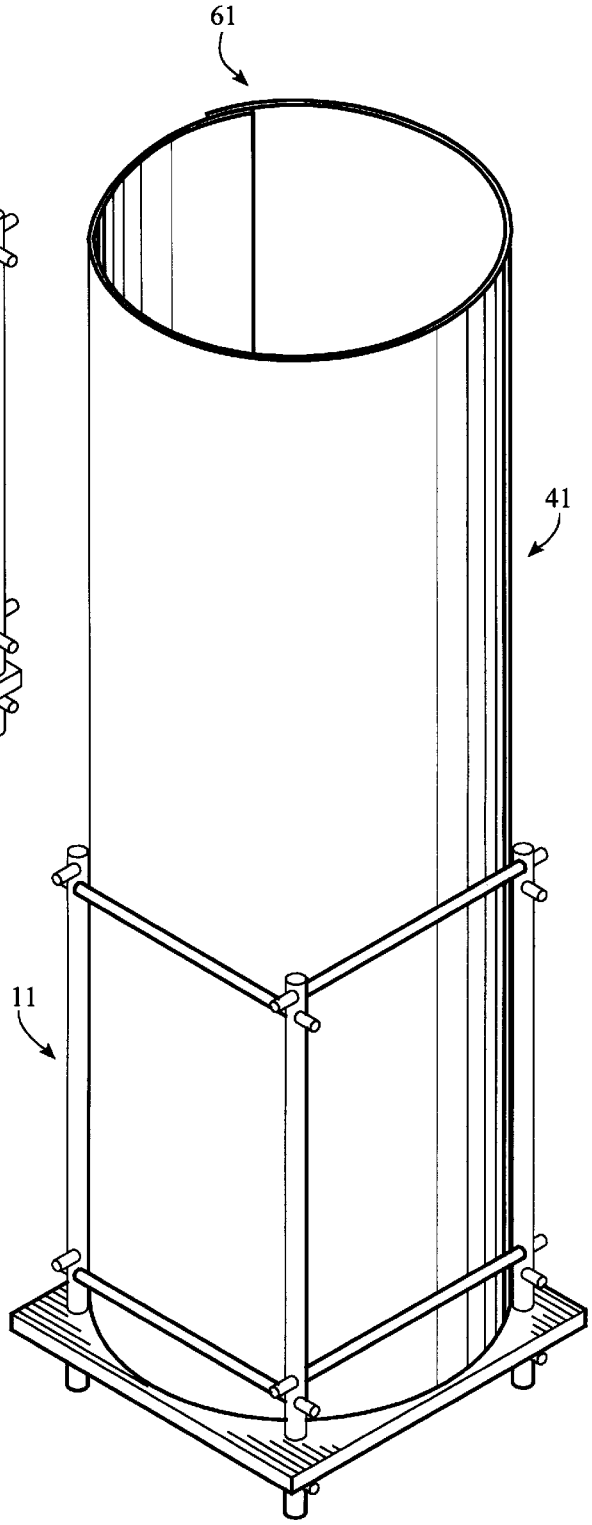
FIG. 6 is a perspective view of a second embodiment of the lamp of the present invention.

FIGS. 5 and 6 show different embodiments of the present invention. In FIG. 5, the lamp 51 is shown to include the rectangular lamp shade 37 disposed within the frame assembly 11. The lamp shade 37 surrounds the lamp bulb assembly 25. As discussed, the lamp shade 37 bulges outwardly at least partially within the side structure of the frame assembly 11 to form a wall. The lamp shade 37 extends upwardly out of the frame assembly such that the frame assembly is not confining the height or shape of the lamp shade 37. The frame assembly 11 provides a surface where the lamp bulb assembly 25 can be mounted and a surface on which the lamp shade 37 can stand.

Referring to FIG. 6, it can be seen that the lamp shade 41 can be formed in a round shape and that the shape of the lamp shade 41 is not dependent on the shape of the frame assembly 11. In FIG. 6, a round lamp shade 41 can be used in a rectangular frame assembly 11. As shown in FIG. 6, the height of the lamp shade is greater than twice the height of the frame assembly 11. As noted above, the lamp shade can be of varying heights, and the height of the lamp shade is not dependent on the frame assembly structure. A typical size of the lamp shade would be 19 in. high, with a perimeter of 27 in., which would be similar to the height of the lamp shade 37, shown in FIG. 5. When a user wants to change the style of the lamp, all the user has to do is lift out the lamp shade and replace it with a different lamp shade. Changing the lamp shade is easy and does not affect the frame assembly or the lamp bulb assembly. In this way, with many shapes and styles of lamp shades, the user can achieve a new look for the lamp without having to buy new lamps. This allows for flexibility in the lamp's style and use.

Figure 7:
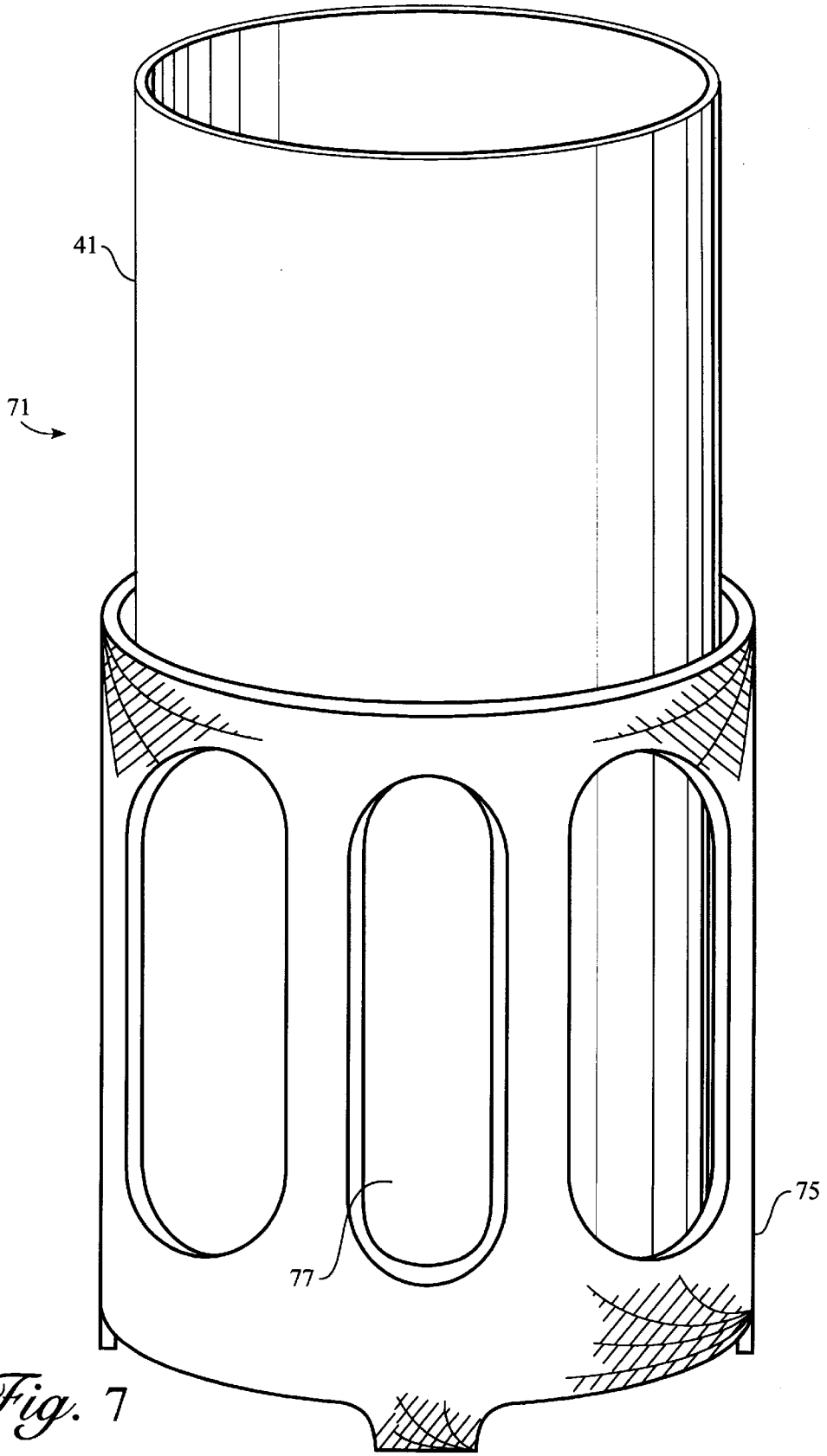
FIG. 7 is a perspective view of a third embodiment of the lamp of the present invention.

Additionally, different frame assemblies can be used other than the preferred embodiment 11, shown in FIG. 1. FIG. 7 shows another embodiment of the lamp 71, using a different type of frame assembly 75. The frame assembly 75 is a single piece, round-shaped structure having decorative openings 77 arranged around the side walls. In FIG. 7, the round lamp shade 41 is shown to be disposed in the frame assembly 75. The lamp shades can be used in round frame assemblies, such as shown in FIG. 7, or with other shapes and sizes of frame assemblies. In this way, the user will have an adaptable lamp that will look good for any occasion.

I claim:

1. A lamp comprising:

a coiled lamp shade of a translucent sheet arranged in a loop bulging outwardly to form a wall, the lamp shade standing on a flat surface;

a lamp bulb assembly disposed on the flat surface and being surrounded by the lamp shade;

a frame assembly consisting of an open top, and a side structure of a defined perimeter and defining a space within the perimeter;

the coiled lamp shade being disposed within the frame assembly, the wall being inside of the space defined by the perimeter of the side structure of the frame assembly and extending upward beyond the side structure;

a bottom panel connected to the side structure of the frame assembly, the lamp shade standing on the bottom panel, and the lamp bulb assembly being disposed in an opening in the bottom panel;

the frame assembly having a set of four posts, each of the posts having a top end and a bottom end and being mounted vertically so that the bottom end attaches to a corner of the bottom panel, the posts being perpendicular to the bottom panel;

a set of four upper horizontal members having opposed ends, each of the upper horizontal members connecting with the top ends of two adjacent posts to form a rectangular shape when all upper horizontal members are interconnected; and a set of four lower horizontal members having opposed ends, each of the lower horizontal members connecting with two adjacent posts, near the bottom ends of each post, to form a rectangular shape when all lower horizontal members are interconnected.

2. A lamp comprising:

a coiled lamp shade of a translucent sheet arranged in a loop bulging outwardly to form a wall, the lamp shade standing on a flat surface;

a lamp bulb assembly disposed on the flat surface and being surrounded by the lamp shade; and a frame assembly consisting of an open top, and a side structure of a defined perimeter and defining a space within the perimeter;

the coiled lamp shade being disposed within the frame assembly, the wall being inside of the space defined by the perimeter of the side structure of the frame assembly and extending upward beyond the side structure;

wherein the frame assembly has a defined height, the lamp shade extending beyond the side structure by a distance of greater than the height of the frame assembly.

3. A lamp comprising:

a frame assembly consisting of an open top, a side structure of a defined perimeter and defining a space within the perimeter, and a bottom panel;

a coiled lamp shade disposed within the frame assembly, the lamp shade being of a translucent sheet arranged in a loop bulging outwardly at least partially within the side structure to form a wall inside of the space defined by the perimeter of the side structure of the frame assembly, and extending upward beyond the side structure;

a lamp bulb assembly disposed in an opening in the bottom panel of the frame assembly and being surrounded by the lamp shade;

the frame assembly having a set of four posts, each of the posts having a top end and a bottom end and being mounted vertically so that the bottom end attaches to a corner of the bottom panel, the posts being perpendicular to the bottom panel;

a set of four upper horizontal members having opposed ends, each of the upper horizontal members connecting with the top ends of two adjacent posts to form a rectangular shape when all upper horizontal members are interconnected; and a set of four lower horizontal members having opposed ends, each of the lower horizontal members connecting with two adjacent posts, near the bottom ends of each post, to form a rectangular shape when all lower horizontal members are interconnected.

4. A lamp comprising:

a frame assembly consisting of an open top, a side structure of a defined perimeter and defining a space within the perimeter, and a bottom panel;

a coiled lamp shade disposed within the frame assembly, the lamp shade being of a translucent sheet arranged in a loop bulging outwardly at least partially within the side structure to form a wall inside of the space defined by the perimeter of the side structure of the frame assembly, and extending upward beyond the side structure;

a lamp bulb assembly disposed in an opening in the bottom panel of the frame assembly and being surrounded by the lamp shade;

wherein the frame assembly has a defined height, the lamp shade extending beyond the side structure by a distance of greater than the height of the frame assembly.

5. A lamp comprising:

a frame assembly including a bottom panel, a set of four posts, a set of four upper horizontal members having opposed ends, and a set of four lower horizontal members having opposed ends;

each of the posts having a top end and a bottom end and being mounted vertically such that the bottom end is attached perpendicularly to the bottom panel, each of the upper horizontal members connecting with the top ends of two adjacent posts to form a rectangularly shaped open top when all upper horizonal members are interconnected, each of the lower horizontal members connecting with two adjacent posts near the bottom ends of each post to form a rectangularly shaped perimeter when all lower horizonal members are interconnected, the perimeter defining a space inside the frame assembly;

a coiled lamp shade disposed within the frame assembly, the lamp shade being of a translucent sheet arranged in a loop bulging outwardly at least partially within the frame assembly to form a wall inside of the space defined by the perimeter of the frame assembly, and extending upward beyond the frame assembly; and a lamp bulb assembly disposed in an opening in the bottom panel of the frame assembly and being surrounded by the lamp shade.

6. A lamp, as in claim 5, wherein the lamp shade is assembled to have a perimeter of a rectangular shape.

7. A lamp, as in claim 5, wherein the lamp shade is assembled to have a perimeter of a round shape.

8. A lamp, as in claim 5, wherein the frame assembly has a defined height, the lamp shade extending beyond the frame assembly by a distance of greater than the height of the frame assembly.

* * * * *